United States Patent [19]

Johnson

[11] 4,278,394

[45] Jul. 14, 1981

[54] RELEASABLE BOOM LOCK

[75] Inventor: Stephen D. Johnson, Burlington, Iowa

[73] Assignee: J. I. Case Company, Racine, Wis.

[21] Appl. No.: 44,922

[22] Filed: Jun. 4, 1979

[51] Int. Cl.[3] ..... E02F 3/32

[52] U.S. Cl. ..... 414/694; 212/189; 414/722

[58] Field of Search ..... 414/694, 680, 685, 722, 414/687; 212/46 R, 145

[56] References Cited

U.S. PATENT DOCUMENTS

| | | | |
|---|---|---|---|
| 3,365,214 | 1/1968 | Garnett | 212/145 X |
| 3,376,984 | 4/1968 | Long | 414/694 |
| 3,734,320 | 5/1973 | Redenbarger | 414/694 |
| 3,811,582 | 5/1974 | Shomaker | 414/694 |
| 3,921,835 | 11/1975 | Baker | 414/694 |
| 3,951,281 | 4/1976 | Parquet | 212/145 X |
| 3,955,695 | 5/1976 | Maurer | 212/145 X |
| 4,039,093 | 8/1977 | Schmitz, Jr. | 414/680 |
| 4,184,803 | 1/1980 | Housman | 414/722 X |
| 4,189,278 | 2/1980 | Dewey | 212/145 X |

*Primary Examiner*—Leslie J. Paperner
*Assistant Examiner*—Terrance L. Siemens
*Attorney, Agent, or Firm*—Dressler, Goldsmith, Shore, Sutker & Milnamow, Ltd.

[57] ABSTRACT

A device for locking a boom to a boom support structure as used in earthworking implements is described. A lug having a camming surface is provided on the boom or on the boom support structure as the case may be. The opposite structure is provided with a pivoted arm joined to a lock pin. Motion of the boom toward the boom support structure engages the lock pin and camming surface. Continued movement boom toward the boom support structure forces the lock pin over the lug. Subsequent movement of the boom away from the boom support structure so as to separate the two is prevented by virtue of the lock pin engaging the back side of the lug. A pull cable actuated by the equipment operator disengages the lock pin from the cam thereby permitting free movement of the boom and boom support structure. A bias spring maintains the pivot arm and lock pin in one position unless the lock pin engages the camming surface of the lug.

1 Claim, 5 Drawing Figures

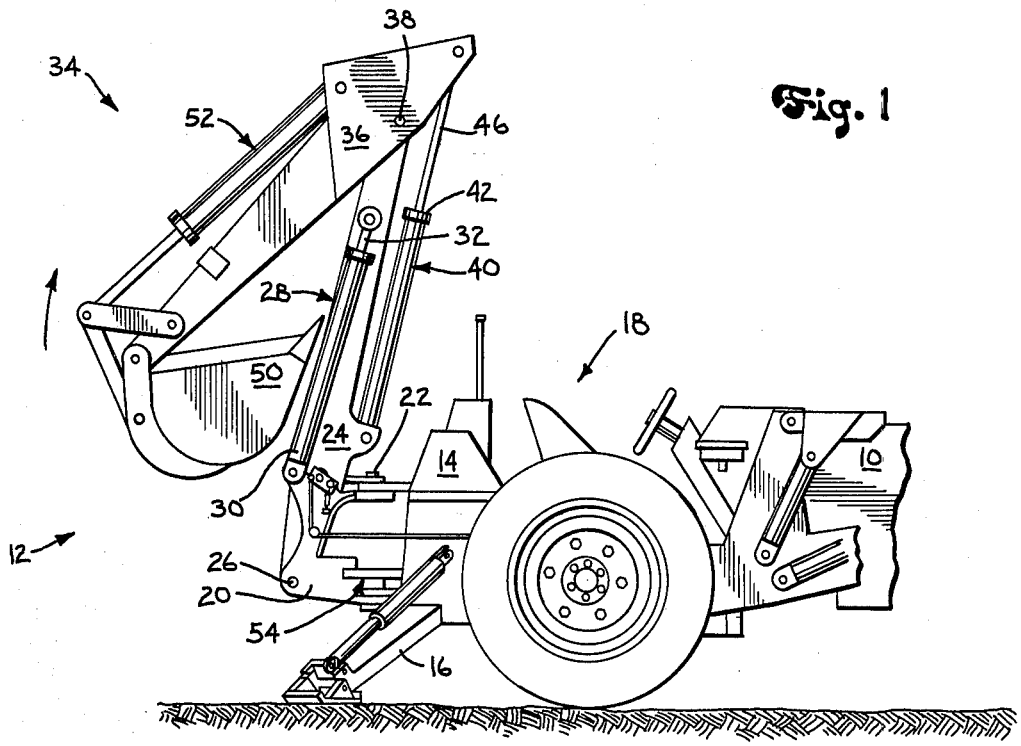
Fig. 1
Fig. 2
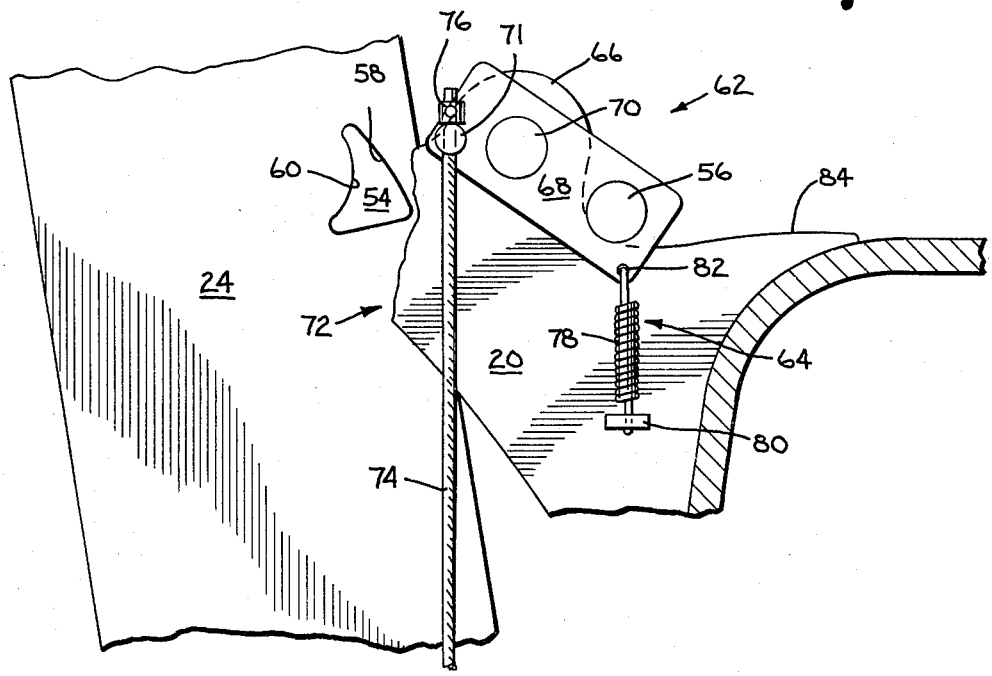

RELEASABLE BOOM LOCK

DESCRIPTION

1. Technical Field

An apparatus for locking boom structures employed in civil engineering equipment. In particular, it applies to those vehicles used in earthworking employing a boom upon which an earthworking implement is attached, and to those vehicles wherein the boom is pivoted about a horizontal axis on a boom support structure. The present invention is an improved device for locking the boom to the boom support structure of the type disclosed in U.S. Pat. No. 3,376,984 by Long and assigned to the assignee of the present invention.

In conventional earthworking equipment employing a boom or a boom-like structure, the boom must be placed in a position suitable for transportation if the boom is to remain attached to the vehicle. This position is referred to as the transport or transportation position. In such a position the boom is generally brought as close to the center of gravity of the vehicle as possible. This is done to improve the stability of the vehicle while moving on highways and to minimize the space occupied vehicle when it is placed in storage. The safety, the personnel and proper protection of the equipment demands that a positive means be used to hold the boom in the transport position. In addition, the boom is locked in a near vertical position when it is desired to lift payloads using the earthworking tool attached to the boom. Thus, when the boom is used like a crane, locking the boom mechanically allows maximum utilization of hydraulic power by the moving components pivoted to the boom.

2. Background Art

A representative item of earth working equipment employing a boom is a backhoe. Backhoes normally consist of a boom that is pivoted on a vehicle by a fluid ram and an earthworking tool or bucket assembly that is pivoted on the free end of the boom by a second fluid ram. During transportation or storage, the boom and equipment attached thereto is positioned so as to occupy the least floor space. In addition, this makes movement on public roads more convenient and safe since the center of gravity is shifted closer to the vehicle wheels. A transport position is generally disclosed in Long et al., U.S. Pat. No. 3,376,984. In that patent, the boom is swung to a transport position that is generally vertical and slightly forward of the vertical axis extending through the boom and its support. The boom was held locked in the transport position by the boom fluid ram which had gone "over-center". While that arrangement is acceptable, there are times when it is desirable to positively interlock the boom and its support without relying on the fluid in the boom rams.

One method of positively interlocking the boom and its support without relying on the fluid in the boom rams is disclosed in Shumaker et al., U.S. Pat. No. 3,811,582 and assigned to the assignee of the present invention. While that method is satisfactory, it is particular to earth working implements of a specific type (i.e., ones with a fluid ram actuating a tool with a member pivoted intermediate its ends). In addition, the operator is never certain that the interlock will be released upon the actuation of the controls. A certain amount of finesse and coordination is needed; successive attempts might be necessary. Therefore, a positive and certain means of releasing the interlock between the boom and its support is still preferred by most operators.

The interlock between the boom and boom support described herein does not require that the tool associated with the boom be attached to the boom in any particular fashion. Consequently, this interlock has application to earth moving equipment and backhoes of more general design. Finally, the release of the interlock is under positive control of the equipment operator.

In the conventional backhoe arrangement, the transport position is characterized by a generally vertically and slightly rearwardly extending boom carrying a folded dipper stick pulled in as close as possible to the boom to hold the main center of gravity for the backhoe as near as possible to the rear end of the mounting vehicle. The ability of the boom to assume a more forwardly inclined relationship affects the improvement in the position of the overall center of gravity to provide better balance and handling. It also limits the backhoe tail swing which is of concern in close quarter operations.

SUMMARY OF THE INVENTION

According to the present invention, the boom is positively locked in a predetermined angular or transport position by horizontally pivoting the boom to its transport position. In moving to the transport position, a releasable lock means automatically locks the boom to its supporting structure.

The releasable lock means consists of a first element carried by the boom or the structure supporting the boom, the boom support. The second element is carried by the structure opposite the first element. A mounting means normally maintains the second element in a first position and accommodates movement from this position. The first element has a camming surface for guiding the second element around the first element during pivotal movement of the boom to the transport position. Subsequent rotation of the boom away from the boom support is prevented by virtue of the first element being restrained by the second element. The two elements are separated by actuating a pull cable to cause the first element to disengage from the second element, thereby allowing the boom to be pivoted away from the transport position. A positive means of holding the two elements in position is to employ a biasing means. This insures positive locking of the two elements and prevents inadvertent separation of the elements.

BRIEF DESCRIPTION OF THE DRAWINGS

FIG. 1 is a fragmentary side view of a vehicle having an earthworking implement mounted thereon and having the present invention incorporated therein;

FIG. 2 is an enlarged, fragmentary elevation view showing the details of the releasable lock means in the "at rest position";

DETAILED DESCRIPTION

Figure 3:
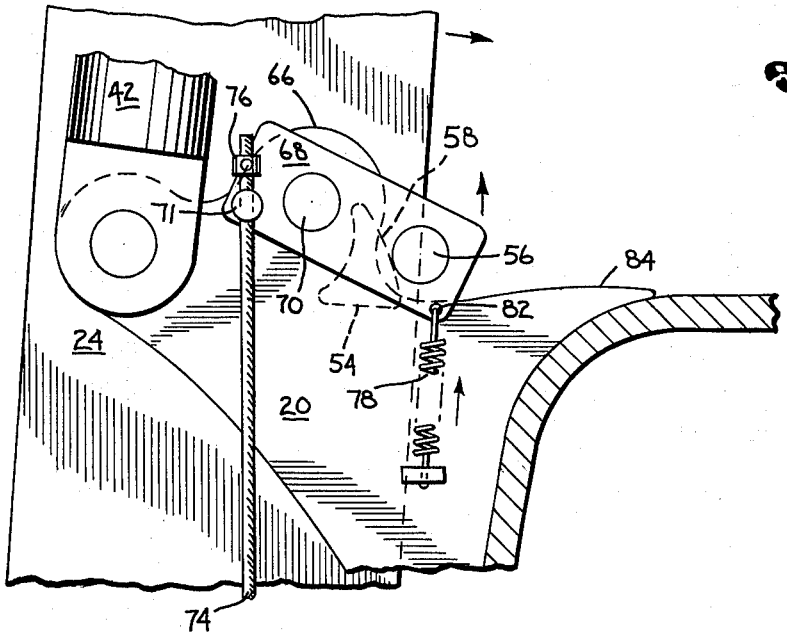
FIG. 3 is an enlarged, fragmentary elevation view of the releasable lock means in the "engaging position"
Figure 4:
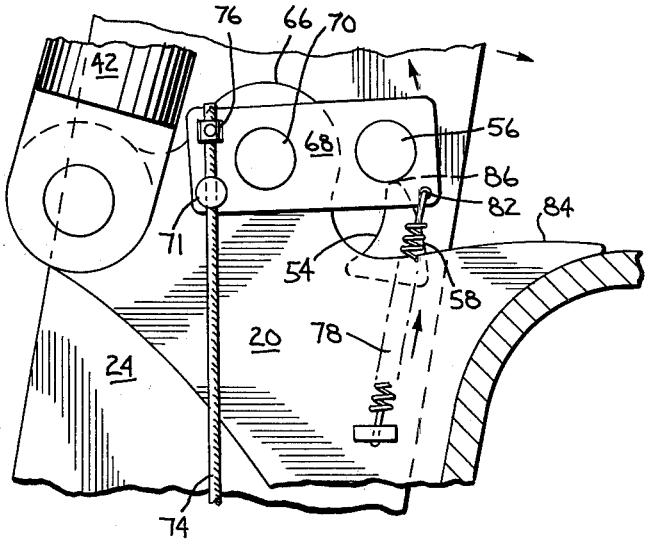
FIG. 4 is an enlarged, fragmentary elevation view of the releasable lock means in a position prior to tripping towards the locked position.

While this invention is susceptible to embodiment in many different forms, there is shown in the drawings and will herein be described in detail an embodiment with the understanding that the present disclosure is to be considered as an exemplification of the principles of the invention and is not intended to limit the invention to the embodiment illustrated.

FIG. 1 of the drawing shows a vehicle generally designated by reference numeral 10, having an earth-working tool or implement 12 supported thereon. The implement 12 consists of a backhoe which includes a frame 14 having outriggers 16 supported thereon with the frame being attached to the end of the vehicle, adjacent an operator's station 18. The operator's station 18 may be part of the vehicle or may be a separate area on the frame 14.

A swing tower or boom support 20 is pivoted about a vertical axis defined by two vertical pivot means or pins 22, which will be described in more detail later, while a boom 24 is supported at its lower end by a horizontal pivot pin 26 on the boom support or swing tower 20. The boom 24 is pivoted about a horizontal pivot axis (defined by the horizontal pivot pins 26) by a pair of boom fluid rams 28 (only one being shown) located on opposite sides of the boom 24 with the cylinder 30 of the ram secured to the boom support 20 and the piston rod 32 secured to the boom 24. A dipper stick assembly 34 is supported on the other end of said boom; it includes a member 36 pivoted intermediate its ends on the free end of the boom 24 by pivot pin 38. Movement of the member 36 is controlled by a dipper stick fluid ram 40 having its cylinder 42 pivotally supported on the boom adjacent to the boom support 20 with its piston rod 46 pivotally supported on one end of the member 36 by a pin 48. A bucket 50 is provided on the opposite or outer end of dipper stick by an additional fluid ram 52. Finally, other fluid rams 54 are used to pivot the boom support about the vertical axis.

The details of the releasable lock means are shown in FIGS. 2 through 5, wherein a leg or first element 54 is shown attached to the boom 24 and a lock pin or second element 56 is shown carried on the boom support 20.

The lug has two direction controlling surfaces: an "engaging surface" 58 for guiding the lock pin into a locked position and a "locking surface" or declivity 60 to hold the pin 56 in the locked position.

A support means 62 is used for supporting the lock pin 56. In particular, the support means 62 includes a biasing means 64 for normally maintaining the lock pin in one position (a so called first position) and for accommodating movement from that position as well as an actuation means for separating the first and second elements. This is clearly shown in FIGS. 2 through 5.

In FIG. 2 the lock pin 56 is shown supported by the boom support 20. The support means includes: a lug 66 attached to the boom support; a pivot arm 68; a pivot pin 70 joining the pivot arm to the lug; a biasing means 64 at one end of the pivot arm; and an eyelet 71 opposite the bias means. A release means 72 attached to the eyelet 71 serves to rotate the pivot arm 68 and lock pin 56 about the pivot pin 70. As specifically illustrated in FIGS. 2 through 5, the release means is a flexible cable 74 passing through the eyelet 71 with a stop 76 at the end of the cable. Finally, the bias means 64 is represented by a spring 78 secured to the boom support structure at one end by a tab 80 and secured at the other end through a hole 82 in the pivot arm 68. By virtue of the bias means 64, the pivot arm 68 and lock pin 56 are normally in a position defined by one of the movable elements of the support means coming in contact with the structure (i.e., the boom 24 or boom support 20) to which it is attached. As specifically illustrated in FIG. 2, the lock pin 56 comes to rest against the upper portion of the boom support adjacent to the lug 66. Thus, a surface 84 on the boom support structure cooperating with the moving portions of the support means 62 defines a first position or a normal position of the lock pin 56.

FIG. 2 shows the boom and boom support structure in a position prior to engagement of the lock pin 56 and lug 54. As the boom 24 is rotated clockwise (i.e., toward the boom support 20), the boom and boom support assume the position shown in FIG. 3. At this position the leading edge of the lug or engaging surface 58 will come into contact with the lock pin 56. Thus, FIG. 3 identifies the lug and lock pin in the "engaging position". The two elements become further engaged as the boom continues to move clockwise; the lock pin follows and moves along the leading edge of the lug thereby overcoming the resistance of the bias means 64.

Figure 5:
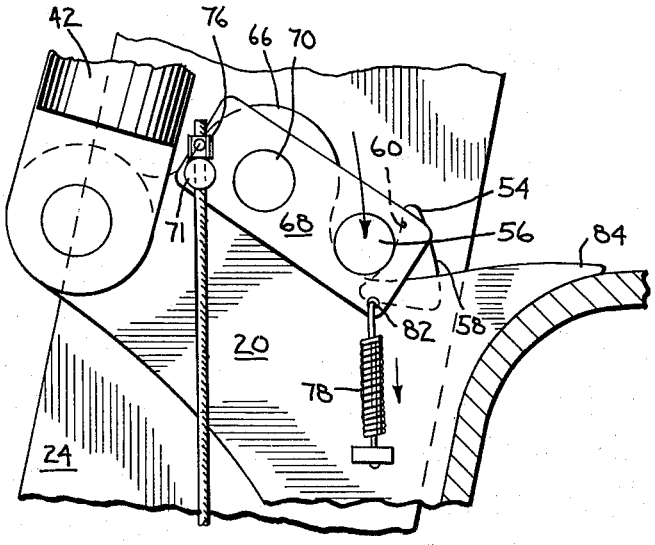
FIG. 5 is further enlarged, fragmentary elevation view of the releasable lock means in the "locked position."

When the lock pin reaches the top 86 or trip point of the lug 54 (See FIG. 4,) the pivot arm 68 has rotated to its maximum counterclockwise position. Once the lock pin 56 passes over the top 86 of the lug, it falls into the "locked position". This is shown in FIG. 5. In order to accommodate the motion of the lock pin 56 as it falls past the lug 54, the locking surface 60 of the lug 54 is provided with a curvature matching that of the arc defined by the lock pin 56 pivoting about pin 68.

Once in the locked position, motion of the boom relative to the boom support is restrained. With respect to clockwise motion of the boom, motion is restrained by the boom support structure 20. With respect to counterclockwise direction, the lock pin 56 and lug 54 are forced together along the locking surface of the lug, thereby preventing counterclockwise motion of the boom so as to separate the boom from the boom support.

In order to release the boom 24 from the boom support 20 and thereby permit counterclockwise rotation, the release means is operated. Pulling cable 74 in the downward direction acts to overcome the biasing means 64 and rotates the lock pin 56 in the counterclockwise direction. This raises the lock pin 56 beyond the top of the cam 86, freeing the boom 24 from its support 20 and permitting the boom to be driven by the fluid rams in a counterclockwise direction. Once the lug 54 passes clear of the lock pin 56, the release means may be released; this allows the lock pin to slip past the engaging surface of the cam and into its normal or first position (FIG. 2).

While a spring biasing means has been used to assist the motion of the pivot arm, the same effect could be achieved without the biasing means. Reliance would then be made on gravity alone for rotation of the pivot arm in the clockwise direction when the boom is unlocked.

In summary, when it is desired to lock the boom in the transport position, it is only necessary for the operator to manipulate his controls (not shown) and extend the fluid ram 40 to the position shown in FIG. 1, wherein the bucket 50 is located in close proximity to the boom. The boom is then swung towards the operator's station by proper manipulation of the fluid rams 28.

During such movement, the lock pin 56 engages the lug 54. The camming surface 58 on the lug forces the lock pin 56 past the lug 54 and into engagement with the locking surface 60 of the lug. The lock pin 56 is assisted in tripping to this position by the bias means 64. The bias means also maintains the lock pin in the locked position providing a positive interlock between the boom 24 and the support 20 in the transport position. Actuation of a pull cable frees the boom and boom support by rotating the lock pin free of the lug.

It will be appreciated that the position of the two elements 54 and 56 can be reversed and that the spring biasing element may be carried by boom 24 rather than by the boom support 20.

Finally, it should be realized that the drawings shown in FIGS. 2 through 5 are cross-sectional views of the boom and boom support. That is to say, there is a symmetrical structure on the opposite side of the centerline of the boom and boom support. This symmetrical structure is not necessary but is recommended to balance the forces locking the boom and boom support.

I claim:

1. In an earth-working implement having a boom pivoted on a boom support about a horizontal axis, a member pivoted about a horizontal axis on the free end of the boom, a hydraulic ram pivoted at one of its ends to the boom and at its opposite end pivoted to said member so that extension and retraction of the hydraulic ram pivotally rotates said member and pivots that end of the hydraulic ram pivoted to the boom, and a releasable lock means between said boom support and said boom, wherein the improvement comprises: releasable lock means having a first element carried by said boom and defining an inclined camming surface disposed towards the boom support and an adjoining vertically disposed locking surface on the opposite side of said first element as said camming surface, a lug attached to said boom support, a link pivoted to said lug, a second element at the free end of said link, biasing means, carried by the boom support, for normally maintaining said second element adjacent to an abutment on the boom support, said first element being positioned on said boom relative to said second element such that pivotal movement of the boom towards the boom support drives the second element into engagement with the camming surface on the first element, the camming surface being disposed relative to the second element such that it overcomes the biasing means and drives the second element toward the adjacent locking surface as the boom is rotated towards the boom support, the locking surface of said first element being disposed relative to the camming surface such that the biasing means drives the second element across the locking surface and towards the abutment on said boom support when the second element passes over the end of the camming surface, thereby juxtaposing the second element between said abutment and said locking surface and preventing rotation of the boom away from the boom support, and means carried by said link for releasing said second element from its position between the first element on said boom and the abutment on said boom support by pivoting said second element around said first element, thereby freeing said boom to rotate away from said boom support.

* * * * *